United States Patent [19]

Eisenhut

[11] 3,937,631

[45] Feb. 10, 1976

[54] ELECTROPHOTOGRAPHIC MEMBERS INCLUDING POLYVINYLCARBAZOLES AND PLASTICIZERS THEREFORE

[75] Inventor: Wolfgang O. Eisenhut, Woodside, Calif.

[73] Assignee: SCM Corporation, New York, N.Y.

[22] Filed: Dec. 26, 1973

[21] Appl. No.: 428,440

[52] U.S. Cl. ..... 96/1.5; 260/33.2 R

[51] Int. Cl.[2] ..... G03G 5/04; G03G 5/06

[58] Field of Search ..... 96/1.5, 1.6; 260/33.2 R

[56] References Cited

UNITED STATES PATENTS 3,421,891 1/1969 Inami et al. ..... 96/1.5 X

FOREIGN PATENTS OR APPLICATIONS 763,540 8/1971 Belgium ..... 96/1.5

2,127,351 9/1972 France ..... 96/1.5

*Primary Examiner*—Roland E. Martin, Jr.

*Attorney, Agent, or Firm*—Armand G. Guibert; Milton M. Wolson

[57] ABSTRACT

A multilayer electrophotographic member (such as a plate or flexible web) of the type for producing an electrostatic latent image thereon has a layer of photoconductive material, such as selenium, overlain by a charge image bearing layer comprising an organic polymeric material having the ability to transport electrical charge carriers therethrough, such as polyvinylcarbazole. The charge image bearing layer also has incorporated therein a plasticizer material selected from the group consisting of phenylether, its oligomers and substituted derivatives of the phenylether moiety.

17 Claims, No Drawings

ELECTROPHOTOGRAPHIC MEMBERS INCLUDING POLYVINYLCARBAZOLES AND PLASTICIZERS THEREFORE

BACKGROUND OF THE INVENTION

The present invention relates in general to electrophotographic members and more particularly to such members of the multilayer type having an organic polymeric charge image bearing layer overlying a photoconductive layer, as of selenium.

DESCRIPTION OF THE PRIOR ART

Heretofore, multilayer electrophotographic members have been made for producing an electrostatic latent image thereon. The charge image can be transferred from or developed on the charge image bearing layer of the electrophotographic member. Such multilayer electrophotographic members are described and claimed in U.S. Pat. No. 3,725,058 issued Apr. 3, 1973.

Briefly, the prior art multilayer electrophotographic member comprises an electrically conductive plate—as of metal, or metal on Mylar (TM for polyester film manufactured by E. I. Dupont de Nemours, Inc., Wilmington, Del.), or conductive paper — having an overlying layer of vitreous selenium photoconductive material supported thereon either directly or indirectly through an adhesive layer. The vitreous selenium layer has an adjacent overlying layer of organic polymeric insulating material, such as poly-N-vinyl-carbazole, which is substantially non-light sensitive in the visible ray region, but does have the ability to act as a charge carrier transport material. Charges generated in the vitreous selenium layer can be injected into the overlying layer and transported therethrough to neutralize surface charges during the electrophotographic process.

The conductive plate can be rigid or flexible. In the case of a flexible conductive plate, the plate is formed, in a typical example, by a Mylar (TM) sheet having an aluminum layer laminated thereon to form the conductor. An adhesive layer, such as Pyre ML (TM for polyimide resin manufactured by the above-mentioned DuPont Company), is applied over the aluminum layer for bonding the vitreous selenium to the conductive aluminum layer. In a typical example, the Mylar (TM) layer is 100 microns thick, the aluminum layer is 13 microns thick, the adhesive layer is 10 microns thick, the selenium layer is 0.5 microns thick, and the organic polymeric charge bearing layer is about 0.1 to 1.0 mil thick.

It is also proposed in the abovecited patent to incorporate a plasticizer selected from the group consisting of chlorinated diphernyl, epoxy resin, and dioctyl phosphate into the organic polymeric insulative charge bearing layer for increasing the flexibility of the layer.

While incorporation of such prior art plasticizers into the charge bearing polymeric organic layer serves to increase the flexibility of the resultant electrophotographic member, for reasons of providing reasonable life for belt-type photoconductors, it is desirable to further increase flexibility of the layer and in the process to improve the adhesion between the selenium and charge bearing layers. It is further desired to render the charge image bearing layer more resistant to stress cracking and to the surface damage occasioned by exposing the multilayer material to solvents such as a saturated hydrocarbon liquids used as carriers in liquid-toned copy machines.

SUMMARY OF THE PRESENT INVENTION

The principal object of the present invention is the provision of an improved electrophotographic member and method of making same.

In one feature of the present invention, the organic polymeric charge image bearing layer of a multilayer electrophotographic member has a plasticizer material incorporated therein selected from the group consisting of phenylether, oligomers of phenylether, and derivatives of the phenylether moiety with substituents attached to the aromatic nuclei, whereby the flexibility, interlayer adhesion, and resistance to stress cracking of the plasticized layer is improved.

In another feature of the present invention, the charge image bearing layer of a multilayer electrophotographic member is made of polyvinylcarbazole incorporating therein a plasticizer selected from the group consisting of bis (m-phenoxyphenyl) ether, m-bis (m-phenoxyphenoxy) benzene, and m-bis [m(phenoxyphenoxy) phenoxy] benzene. The plasticizer may comprise mixed isomers of the substituted derivatives of the phenylether moiety or of the justmentioned ethers. Optionally, the charge image bearing layer may also contain one or more polymeric extenders such as polycarbonate, polyphenylene ether or polysulfones.

In another feature of the present invention, the organic polymeric material of the charge image bearing layer of a multilayer photoconductor — plasticized as in the foregoing — is selected from the group consisting of polyvinylcarbazole, poly-N-vinylcarbazole, polyacenaphtylene, poly-9-(4-pentenyl)carbazole, poly-9-(5-hexyl)carbazole, poly-3-aminocarbazole, brominated poly-N-vinylcarbazole, copolymers of N-vinylcarbazole with acrylates and poly-9-vinylanthracene. The organic polymeric material may also be a mixture of poly-N-vinylcarbazole and at least one of the other materials in the group.

In another feature of the present invention, the plasticizer, before incorporation into the organic polymeric charge image bearing layer of the multilayer photoconductor, is purified by passing the plasticizer through an adsorption chromatographic purifier.

DESCRIPTION OF THE PREFERRED EMBODIMENTS

A multilayer electrophotographic plate for producing an electrostatic latent image thereon is provided with improved flexibility, interlayer adhesion, and resistance to stress-cracking by incorporating certain plasticizer material into the organic polymeric charge image bearing layer thereof. Multilayer electrophotographic plates of the same type as that of the present invention, with the exception of the provision of the improved plasticizer of the present invention, are disclosed and claimed in the aforecited U.S. Pat. No. 3,725,058, the disclosure of which is hereby incorporated by reference.

Briefly, a multilayer electrophotographic plate to which the plasticizers of the present invention are applicable, includes an electrically conductive plate or substrate such as a Mylar (TM) sheet with an aluminum conductive coating formed thereon. Amorphous selenium, forming the photosensitive layer, is deposited either directly overlying the aluminum layer or affixed to the aluminum layer via the intermediary of a suitable adhesive layer, as of Pyre ML (TM) adhesive. The special plasticized organic coating of the present invention is deposited overlying the selenium layer and comprises an organic polymer having the ability to transport electrical charge carriers. Such suitable organic polymers include, for example, polyvinylcarbazole, poly-N-vinyl-carbazole, polyacenaphthylene, poly-9-(4-pentenyl) carbazole, poly-9-(5-hexyl) carbazole, poly-3-aminocarbazole, brominated poly-N-vinylcarbazole, copolymers of N-vinylcarbazole with acrylates and with poly-9-vinylanthracene; and mixtures thereof with poly-N-vinylcarbazoles. Plasticizers of the present invention are incorporated into the organic polymer layer to improve the flexibility, interlayer adhesion, and resistance to stress-cracking of the resultant coating. Examples of suitable plasticizers include phenylether, oligomers of phenylether, and derivatives of the phenylether moiety with one or more substituents attached to the aromatic nuclei. Products comprising isomeric mixtures of the various materials are intended to fall within the scope of the invention. Substituents can be halogen, nitro, nitroso, amino, amido, cyano, ester, alkyl, aryl, acyl, fused aryl, and alkyl aryl groups or combinations thereof. More specifically, such plasticizers include bis(m-phenoxyphenyl) ether, m-bis (m-phenoxyphenoxy) benzene, and m-bis-[m(phenoxyphenoxy)phenoxy]benzene.

The charge image bearing layer containing a plasticizer according to the present invention is substantially transmissive to visible light, substantially non-light sensitive in the visible range, and allows transport of charge carriers generated in the thin underlying layer of vitreous selenium when this layer is struck by light, i.e. in imagewise fashion. Because of the effect of the aforecited plasticizers on the flexibility, surface hardness, cohesion, etc., of the electrophotographic member, the concentration of the plasticizer is chosen for optimum properties and can vary from 1 to 100 parts of plasticizer per 100 parts of the organic polymer material by weight. The improved stress-cracking property of the coating of the present invention also encompasses the property of reducing surface damage occasioned upon exposing the multilayer electrophotographic plate to solvents such as the saturated hydrocarbon liquids used as carriers in liquid-toned copying machines. The improved resistance to such solvents apparently sets in, however, only at plasticizer concentrations of 20 parts or more per hundred of the organic polymer material (the term "parts" as used herein refers to parts by weight and the abbreviation "phr" will be used hereinafter to designate the parts by weight of plasticizer per hundred parts by weight of polymer). In a preferred embodiment, to improve photodecay properties of the photoconductor, the plasticizer is purified prior to incorporation in the organic layer by adsorption chromatography on aluminum oxide. Flexibility of the plasticized organic layer is also improved by the addition of a minority concentration of anthracene. A number of specific examples and test results follow:

EXAMPLE I

A strip of multilayer photoconductor substrate comprising Mylar (TM), aluminum, Pyre ML (TM an adhesive), and amorphous selenium in thicknesses of about 100 microns, 13 microns, 10 microns, and 0.5 microns, respectively, is coated with poly-N-vinylcarbazole plasticized with bis (m-phenoxyphenyl) ether purified by adsorption chromatography on aluminum oxide. The coating solution comprises 2.5 grams of poly-N-vinylcarbazole, 50 grams of solvent (such as chlorobenzene), and 56 parts by weight of the aforecited purified plasticizer mixed with each hundred parts of the poly-N-vinylcarbazole, i.e. 56 phr. The resultant coating solution is applied with a 4-mil doctor blade. The film is allowed to dry for 1 hour at room temperature and for 30 minutes at 50° Centigrade. The resultant film thickness is in the range of 0.15 to 0.3 mil.

The resultant electrophotographic member was tested for its various properties as follows: The charge image bearing surface of the organic layer was charged to a corona voltage of −9.6 KV and had an apparent surface voltage (ASV) of 820 volts. When energized with light from a G.E. lamp No. 1129, the time (light decay-time, a measure of the light sensitivity of the photoconductor) required to discharge the surface to 50%, 20% and 10%, respectively, of the original apparent surface voltage (ASV) was measured. In addition, the persistent residual voltage after 30–45 seconds was measured at 50% relative humidity and 22.2°C. The time required to discharge to 50% of ASV was 0.33 sec., to 20% ASV was 0.55 sec., and to 10% of ASV was 1.0 sec. The residual voltage was 30 volts. The adhesion of the plasticized polymeric layer was measured by means of a "Scotch" (TM of the 3M Company, St. Paul, Minnesota) tape test wherein an area of the coating 1.2 × 1.5 cm. was scribed into 20 squares, a piece of tape (Scotch brand transparent adhesive tape 3M No. 810) was applied to the area and then removed, after which the percentage of the coating removed in the scribed area was determined. In this test, 80% of the squares remained after tearing off a piece of Scotch (TM) tape applied to the scribed area. Further, the polymeric layer had a pencil hardness of B according to the well-known pencil hardness test, where the scale of increasing hardness is as follows: B, HB, F, H, 2H, and 3H. The flexibility of the layer was measured by taking a sample strip 1 inch wide and bending it over a mandrel using a 1 Kg weight on either end of the strip to assure application of equal stress. With the material of this example, no cracking was observed at a mandrel diameter of ⅛ inch.

EXAMPLE II

This example is the same as Example I except that the plasticizer was not purified by the adsorption technique. The light decay properties were adversely affected compared to the first example, since more than 5 seconds were required to discharge to 20% of the original ASV. The measured hardness of the plasticized layer was F on the pencil hardness scale, however. Exposure to Isopar G (trademark for a hydrocarbon supplied by the Humble Oil and Refining Co., Houston, Texas) for 370 hours, occasioned no stress cracking.

EXAMPLE III

Example III is the same as that of Example I with the exception that the plasticizer concentration was only 22 phr as contrasted with 56 phr. The 20% light decay occurred at 0.56 sec., the 10% decay occurred at 0.86 sec., and the residual voltage was 20 volts. The adhesion was 35%, and the pencil hardness was F. Very light cracking was observed in the plasticized layer when bending the sample over a ¼ inch diameter mandrel.

EXAMPLE IV

Example IV is the same as Example I with the exception that the plasticizer material is a m-bis(m-phenoxyphenoxy)benzene, with a concentration of 70 parts per hundred parts of the poly-N-vinylcarbazole, corresponding to a mol ratio of 0.304 of plasticizer per mole of the polyvinylcarbazole. The plasticizer was not purified, and the light decay to the 20% point was greater than 5 sec. The adhesion was 90%, and the pencil hardness was H. No cracking was observed in bending the sample over a ⅛ inch mandrel.

EXAMPLE V

Example V is the same as Example IV with the exception that the plasticizer was purified by adsorption chromatograpy on aluminum oxide. The light decay time to the 20% point was 0.54 seconds, to the 10% point was 3.5 seconds, and the residual voltage was 50 volts. The adhesion was 95%, and the pencil hardness was F. No cracking was observed in bending the sample over a ⅛ inch mandrel.

EXAMPLE VI

Example VI is the same as Example V with the exception that the plasticizer concentration was 28 parts per hundred of the poly-N-vinylcarbazole corresponding to a mol ratio of plasticizer to poly-N-vinylcarbazole of 0.122. The light decay time to the 20% point was 0.53 sec., to the 10% point was 0.72 sec., and the residual voltage was 50 volts. The adhesion was 35%, and the pencil hardness was between H and 2H. Only light cracking of the organic layer was observed in bending the sample over a ¼ inch diameter mandrel.

EXAMPLE VII

Example VII is the same as Example I except that only 0.00157 mole of plasticizer was incorporated with 2.5 grams of the poly-N-vinylcarbazole, and the solvent was tetrahydrofuran of Baker Analyzed Reagent grade. In addition, the coating contained 0.25 grams of anthracene. The light decay time to the 20% point was 0.60 sec., and to the 10% point was 3.4 seconds. The residual voltage was 53 volts, and the adhesion was 60%. The pencil hardness was H, and only light cracking was obtained when the sample strip was bent over a ¼ inch diameter mandrel.

EXAMPLE VIII

Example VIII is the same as Example IV with the exception that only 0.00157 mole of plasticizer was incorporated with 2.5 grams of poly-N-vinylcarbazole, and the solvent was tetrahydrofuran. The light decay time to the 20% point was 0.75 seconds, and the light decay time to the 10% point was greater than 5 seconds. The residual voltage was 62 volts, and the adhesion was 5%. The pencil hardness was F, and the sample exhibited medium cracking when bent over a ⅛ inch mandrel.

EXAMPLE IX

Example IX is the same as Example I with the exception that the coating solution contained 5 grams of poly-N-vinylcarbazole and a 7 mil doctor blade was used to apply the coating. The resultant film thickness was 0.8 mil. The time required to discharge to 50% of ASV was 0.4 sec. The measured hardness of the plasticized layer was F on the pencil hardness scale. No cracking was observed at a mandrel diameter of ⅛ inches.

EXAMPLE X

Example X is the same as Example III except that the plasticizer was not purified by the adsorption chromatography technique. After 120 hours of exposure to Isopar G (TM), no stress cracking was seen on bending the photoconductor over a ¼ inch mandrel.

What is claimed is:

1. In a multilayer electrophotographic member for producing an electrostatic latent charge image thereon:

a layer of photoconductive material;

a layer of organic polymeric material overlying said photoconductive layer and having the ability to transport electrical charge carriers therethrough, said layer of organic polymeric material having incorporated therein a plasticizer material selected from the group consisting of oligomers of phenylether, and derivatives of phenylether with at least one aryl substituent attached to the aromatic nuclei, the plasticizer being present in a concentration within the range of 1 to 100 parts of plasticizer per hundred parts of the organic polymeric material by weight.

2. The electrophotographic member of claim 1, wherein said plasticizer material is a product comprising mixed isomers of a said derivative of phenylether.

3. The electrophotographic member of claim 1 wherein said plasticizer material is selected from the group consisting of bis (m-phenoxyphenyl)ether, m-bis(m-phenoxyphenoxy)benzene, and m-bis-benzene.

4. The electrophotographic member of claim 3, wherein said plasticizer material is a product comprising mixed isomers of said last-mentioned ethers.

5. The member of claim 1 wherein said layer of polymeric material is selected from the group consisting of polyvinylcarbazole, poly-N-vinylcarbazole, polyacenaphthylene, poly-9(4-pentenyl)carbazole, poly-9-(5-hexyl)carbazole, brominated poly-N-vinylcarbazole copolymers of N-vinylcarbazole with acrylates, and poly-9-vinylanthracene.

6. The electrophotographic member of claim 1 wherein said layer of polymeric material is poly-N-vinylcarbazole.

7. The electrophotographic member of claim 6 wherein said polymeric material is a mixture including at least one other member of said last mentioned group of polymeric material.

8. The member of claim 1 wherein said layer of polymeric material contains a minority concentration of anthracene.

9. The member of claim 1, wherein said polymeric material has a polymeric extender incorporated therein.

10. The electrophotographic member of claim 6 wherein said plasticizer is selected from the group consisting of bis(m-phenoxyphenyl)ether, m-bis-(m-phenoxyphenoxy)benzene and m-bis-benzene.

11. The electrophotographic member of claim 10 wherein the plasticizer is a material purified by passage thereof through an adsorption chromatographic purifier prior to incorporation in said charge bearing layer.

12. The electrophotographic member of claim 11 wherein the adsorption medium in said chromatographic purifier is aluminum oxide.

13. The electrophotographic member of claim 1 wherein the plasticizer is a material purified by passage thereof through an adsorption chromatographic purifier prior to incorporation in said charge bearing layer.

14. The electrophotographic member of claim 13 wherein the adsorption medium in said chromatographic purifier is aluminum oxide.

15. The electrophotographic member of claim 3 wherein the plasticizer is a material purified by passage thereof through an adsorption chromatographic purifier prior to incorporation in said charge bearing layer.

16. The electrophotographic member of claim 15 wherein the adsorption medium in said chromatographic purifier is aluminum oxide.

17. The electrophotographic member of claim 1 wherein said at least one aryl substituent is fused to an aromatic nucleus.

* * * * *

UNITED STATES PATENT OFFICE
CERTIFICATE OF CORRECTION

Patent No. 3937631 Dated February 10, 1976

Inventor(s) Wolfgang O. Eisenhut

It is certified that error appears in the above-identified patent and that said Letters Patent are hereby corrected as shown below:

Col. 6, line 32, " m-bis-benzene" should be

--m-bis-[m-(phenoxyphenoxy) phenoxy] benzene--

Signed and Sealed this

Twenty-first Day of September 1976

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,937,631

DATED : February 10, 1976

INVENTOR(S) : Wolfgang O. Eisenhut

It is certified that error appears in the above-identified patent and that said Letters Patent are hereby corrected as shown below:

In claim 10, line 4 (column 6, line 59) change "m-bis-benzene" to --m-bis-[m-(phenoxyphenoxy) phenoxy] benzene--.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*